US007611085B2

(12) United States Patent
McIntyre et al.

(10) Patent No.: US 7,611,085 B2
(45) Date of Patent: Nov. 3, 2009

(54) DEVICE AND METHOD FOR IMPROVING POWER FEED EFFICACY FOR COMMINUTING MACHINES

(76) Inventors: Murray McIntyre, 323 Suwannee St., Burns Flat, OK (US) 73624; Jamey Brick, 23955 State Highway 4, Paynesville, MN (US) 56362

( * ) Notice: Subject to any disclaimer, the term of this patent is extended or adjusted under 35 U.S.C. 154(b) by 0 days.

(21) Appl. No.: 12/026,938

(22) Filed: Feb. 6, 2008

(65) Prior Publication Data

US 2009/0194614 A1 Aug. 6, 2009

(51) Int. Cl.
*B02C 23/02* (2006.01)

(52) U.S. Cl. ..... 241/186.35; 241/186.4

(58) Field of Classification Search ..... 241/186.35, 241/186.4, 285.2
See application file for complete search history.

(56) References Cited

U.S. PATENT DOCUMENTS 5,503,339 A * 4/1996 Doppstadt ..... 241/166
5,676,320 A * 10/1997 Merklinger ..... 241/101.741
6,474,579 B1 * 11/2002 Bardos et al. ..... 241/88.4
6,641,065 B2 * 11/2003 Bardos et al. ..... 241/30
6,978,955 B2 * 12/2005 Verhoef et al. ..... 241/223
7,258,293 B2 * 8/2007 Tanaka et al. ..... 241/186.35

* cited by examiner

*Primary Examiner*—Bena Miller
(74) *Attorney, Agent, or Firm*—Altera Law Group, LLC

(57) ABSTRACT

A waste fragmenting machine comprising a power feed system comprising a power feed wheel, an angular yoke connected to the power feed wheel and at least one, preferably two, sets of upper and lower linkage arms, the linkage arms being operatively connected with the machine frame and the angular yoke. The upper and lower arms of each set of linkage arms being arranged within the same vertical plane, but in a non-parallel relationship to each other and the upper arm being shorter in length than the lower arm. The linkage arms adjust the position of the power feed wheel to accommodate the size of feed material, thus maintaining a generally constant downward pressure thereon. Raising the power feed wheel under the present invention maintains the proximity between the power feed wheel and fragmenting rotor by moving the power feed wheel laterally in the direction of the rotor, thus promoting fragmenting efficiency by maximizing feed stability and maintaining steady feed rates.

11 Claims, 5 Drawing Sheets

DEVICE AND METHOD FOR IMPROVING POWER FEED EFFICACY FOR COMMINUTING MACHINES

BACKGROUND OF THE INVENTION

1. Field of the Invention

The invention generally relates to devices and methods for improving the efficiency of material fragmenting machines and more particularly to feeding mechanisms for controlling the flow of material to a comminuting device.

2. Description of the Related Art

Fragmenting machines or waste recycling machines are designed to splinter and fragment wastes under tremendous impacting forces. Waste is defined herein to comprise any material that requires fragmentation prior to utilization, including, inter alia, wood, biofuel and the like. Operationally, waste materials are fed to a fragmenting zone or grinding chamber by power feeding means. Once the waste materials are within the fragmenting zone or grinding chamber, a powered fragmenting rotor that is rotating at high speed and comprising impacting and shearing teeth is encountered. The resulting impact results in the fragmentation and/or comminution of the waste materials to a desired particle size. Generally, one embodiment of a comminuting or fragmenting machine of the present invention may comprise a rotor rotating at about 1800-2500 r.p.m. Those skilled in the art will readily recognize that other r.p.m. ranges are common, e.g., between about 500 and 2500 r.p.m. The invention described herein is not meant to be limited by r.p.m. ranges and, as a result, applies to any comminuting or fragmenting machine using a power feed mechanism. In all cases, a tremendous force is generated at the point of impact between the waste material and the impacting rotor teeth.

Known power feed wheels may be pivotally mounted on an arm with a single rotational pivot point that allows raising or lowering of the power feed wheel in response to the feed material. Typical power feed wheels consist of a single pair of arms, pivotally mounted on a single rotational axis. This known arrangement results in the power feed wheel moving in a radial pathway that is not concentric with the rotor's circumference. Thus, with known pivotally mounted power feed wheels, the radius of the power feed wheel arms is generally greater than the distance between the rotor axis and the striking surface of the rotor teeth. Moreover, the pivot point is generally higher than the rotor axis, which means that the power feed wheel pivots outwardly away from the rotor as it rises. The result is that the critical distance between the portion of the power feed and the portion of the rotor that are contacting the feed material increases with known power feed lifting systems. This inventive linkage lifting system causes this critical distance to decrease as the power feed rises.

As the distance between the rotor and the power feed wheel increases, the power feed wheel loses desired control over the feed material and fragmenting efficacy diminishes.

Accordingly, there remains a need for a power feed lift device and method that maintains a reasonable distance between the fragmenting rotor and the power feed wheel throughout the power feed's lift path, thus enhancing fragmenting efficiency.

The present invention addresses these needs.

BRIEF SUMMARY OF THE INVENTION

Advantageously, certain embodiments of the present invention provide an apparatus and method for a waste fragmenting machine comprising a power feed system comprising a power feed wheel, an angular yoke connected to the power feed wheel and at least one, preferably two, sets of upper and lower linkage arms, the linkage arms being operatively connected with the machine frame and the angular yoke. The upper and lower arms of each set of linkage arms are arranged within the same vertical plane, but in a non-parallel relationship to each other and wherein the upper arm is shorter in length than the lower arm. Raising the power feed wheel under the present invention maintains the proximity between the power feed wheel and fragmenting rotor, thus increasing and promoting fragmenting efficiency.

Another object of the invention is to provide a device and method for increasing efficiency of waste fragmentation.

Another object of the invention is to provide a device and method for maintaining consistent feed rate from the power feed wheel to the fragmenting chamber.

Another object of the invention is to provide a device and method for stabilizing feed material just prior to entry into fragmenting chamber.

Another object of the invention is to provide a device and method for compressing feed material and stabilizing feed material as it is being struck by the rotor teeth.

Another object of the invention is to provide a device and method for maintaining a consistent pressure on feed material as it enters the fragmenting chamber and is struck by the rotor teeth.

Another object of the invention is to provide a device and method for maintaining proximity between the power feed wheel and the fragmenting rotor.

Another object of the invention is to provide a device and method for minimizing the lateral distance between the power feed wheel and the fragmenting rotor when the power feed wheel is in a raised position.

The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF THE INVENTION, INCLUDING THE BEST MODE

Figure 1:
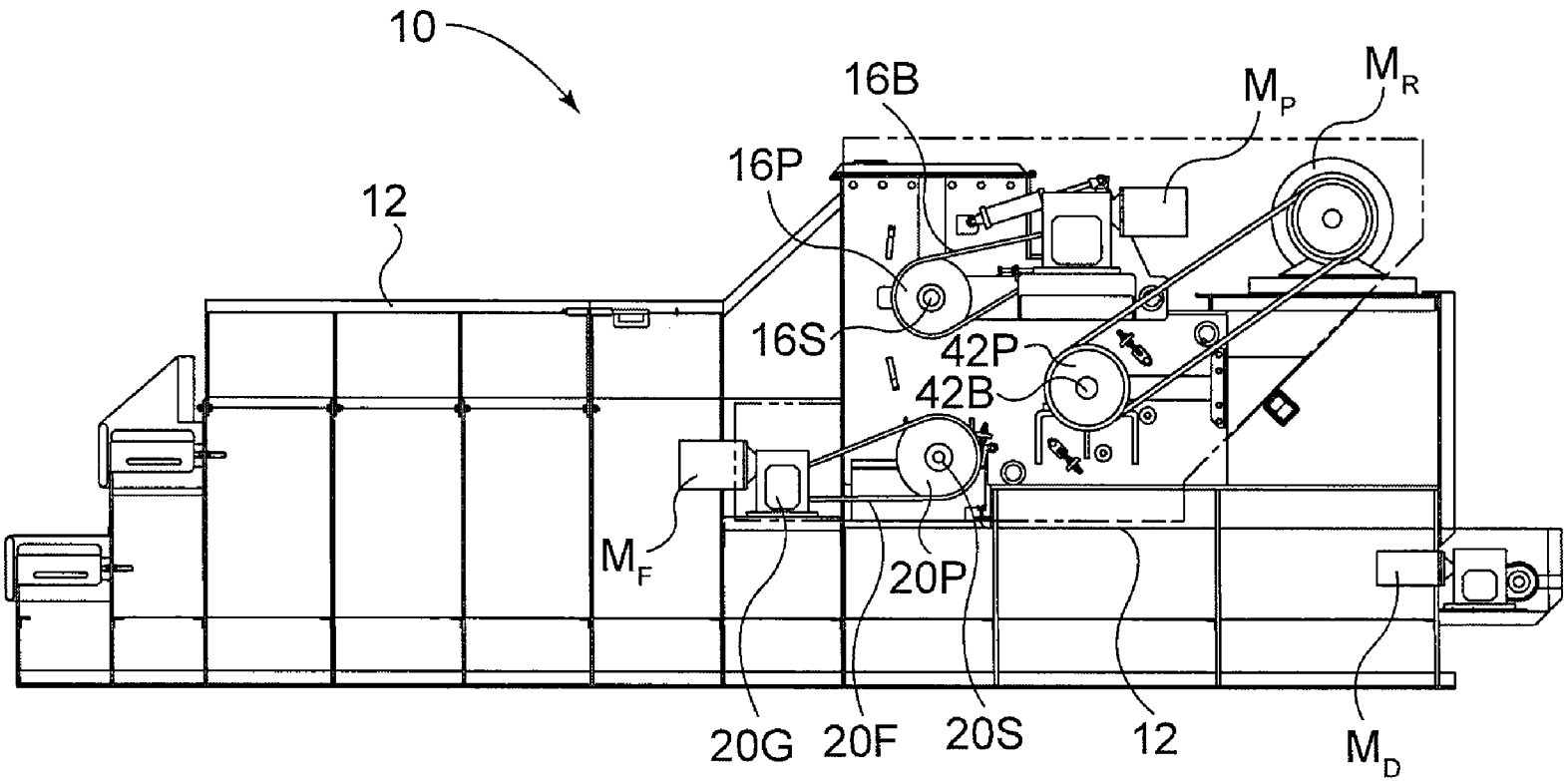
Fig. 1 Prior Art
FIG. 1 is a cross-sectional view of a fragmenting machine.

While the invention is amenable to various modifications and alternative forms, specifics thereof are shown by way of example in the drawings and described in detail herein. It should be understood, however, that the intention is not to limit the invention to the particular embodiments described.

On the contrary, the intention is to cover all modifications, equivalents, and alternatives falling within the spirit and scope of the invention.

Figure 2:
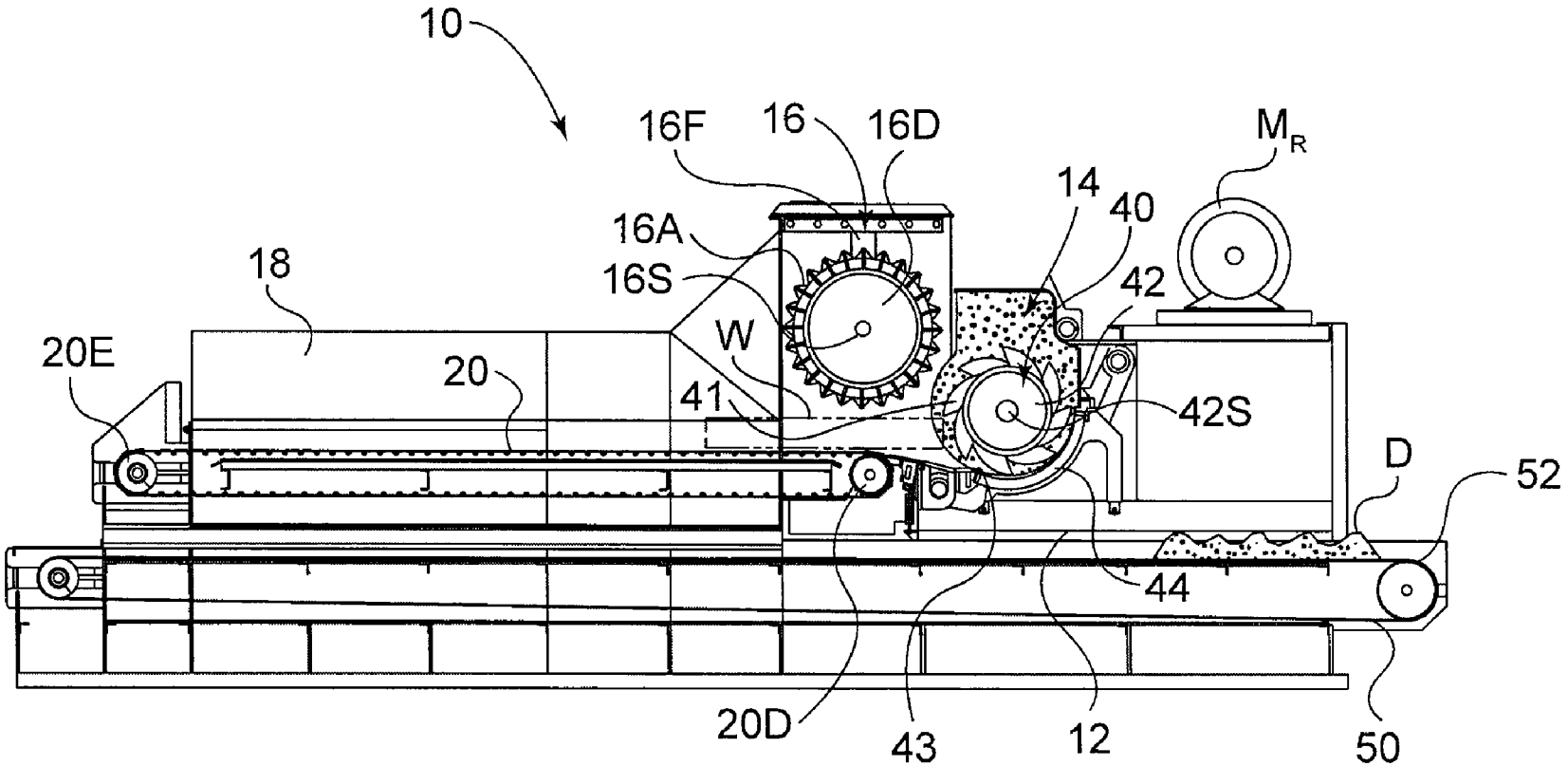
Fig. 2 Prior Art
FIG. 2 is a cross-sectional view of a fragmenting machine.

FIGS. 1 and 2 provide complementary cross-sectional views of one embodiment of a prior art waste fragmenting machine 10, i.e., a horizontal grinder. The machine 10 is designed to splinter and/or fragment wastes under tremendous impacting forces. Such machine may include a frame 12 structurally sufficient to withstand the vigorous mechanical workings of machine 10. One embodiment of the machine 10 may be powered by several electrical motors generally prefixed by M, namely $M_R$, $M_D$, $M_P$, and $M_F$. These electric motors are illustrated as equipped with suitable drive means for powering the various working components, namely the feeding, fragmenting and discharging means of machine 10. It will be obvious to the skilled artisan, however, that the machine 10 may be powered by a variety of different power sources, e.g., internal combustion engines, diesel engines, hydraulic motors, industrial and tractor driven power take-off, etc.

In basic operational use in various embodiments, waste materials W may be power fed by a conveyer system to a fragmenting or grinding chamber 14 by a powered feed system 16 powered by a feed motor $M_F$ in cooperative association with a power feed rotor drum 16D powered by power feed motor $M_P$.

Thus, one embodiment of the machine 10 may include a hopper 18 for receiving waste materials W and a continuously moving infeed conveyer 20 for feeding wastes W to the waste fragmenting or grinding chamber 14. An infeed conveyer 20 may be suitably constructed of rigid apron sections hinged together and continuously driven about drive pulley 20D and an idler pulley 20E disposed at an opposing end of the conveyer 20. The conveyer 20 may be operated at an apron speed of about 10 to about 30 feet per minute, depending upon the type of waste material W. The travel rate or speed of infeed conveyer 20 may be appropriately regulated through control of gearbox 20G. Feed motor $M_F$ in cooperative association with gear box 20G, apron drive pulley 20P, chain 20F, and apron drive sprocket 20D driven about feed shaft 20S serves to drive continuous infeed conveyer 20 about feed drive pulley 20D and idler pulley 20E.

Power feed system 16 is driven by motor $M_P$ and in cooperative association with the infeed conveyer 20, driven by motor $M_F$, uniformly feeds and distributes bulk wastes W such as cellulose-based materials to the fragmenting or grinding chamber 14. Power feed system 16 positions and aligns the waste W for effective fragmentation by the fragmenting rotor 40. The power feed system 16 comprises, in one embodiment and as illustrated, a power feed wheel or rotor drum 16D equipped with projecting feeding teeth 16A positioned for counterclockwise rotational movement about power feed wheel 16D. Power feed wheel 16D may be driven by power feed shaft 16S which in turn is driven by chain 16B, drive sprocket 16P and motor $M_P$. The illustrated embodiment further comprises arm 16F which holds power feed wheel 16D in position. The illustrated embodiment may allow rotation and lifting of power feed wheel 16D with undesirable ever-increasing distance between power feed wheel 16D and fragmenting rotor 40, and waste W, as the wheel 16D is rotated and lifted.

A rotary motor $M_R$ serves as a power source for powering a fragmenting rotor 40 that operates within the fragmenting or grinding chamber 14. The fragmenting and grinding are accomplished, in part, by shearing or breaking teeth 41 which rotate about a cylindrical drum 42 and exert a downwardly and radially outward, pulling and shearing action upon the waste material W as it is fed onto a striking bar 43 and sheared thereupon by the teeth 41. The shearing teeth 41 project generally outwardly from the cylindrical drum 42, which is typically rotated at an operational speed of about 1800-2500 r.p.m, though, as discussed above, other r.p.m. ranges are well within the scope of the present invention. The fragmenting rotor 40 is driven about a power shaft 42S, which is in turn powered by a suitable power source such as motor $M_R$. Motor $M_R$ is drivingly connected to power shaft pulley 42P which drivingly rotates power shaft 42S within power shaft bearing 42B. The rotating teeth 41 thus create a turbulent flow of the fragmenting wastes W within the fragmenting chamber 14.

Initial fragmentation of the waste feed W is, in one embodiment, accomplished within the dynamics of a fragmenting or grinding chamber 14 which may comprise a striking bar 43 and a cylindrical drum 42 equipped with a dynamically balanced arrangement of the shearing or breaker teeth 41. The striking bar 43 serves as a supportive anvil for shearing waste material W fed to the fragmenting zone 4. Teeth 41 are staggered upon cylindrical drum 42 to facilitate dynamic balancing of rotor 40. Rotor 40, generally operated at an operational rotational speed of about 1800-2500 r.p.m., rotates about shaft 42S. Material fragmented by the impacting teeth 41 is then radially propelled along the curvature of the screen 44. Screen 44, in cooperation with the impacting teeth 41, serves to refine the waste W into a desired particle size until ultimately fragmented to a sufficient particle size so as to pass through screen 44 for collection and discharge by discharging conveyor 50. A discharging motor $M_D$ serves as a power source for powering a discharging means 52, illustrated as a conveyor belt and pulley system, wherein the discharging means 52 conveys processed products D from the machine 10.

The power feed system 16 helps, inter alia, maintain a consistent feed rate to the fragmenting chamber and rotor therein. Stabilization of the feed material prior to entry into the fragmenting chamber is essential to fragmentation speed and efficiency. The need for feed stability in a fragmenting machine is relative to the size and consistency of the feed material, as well as the rotor r.p.m. and torque. Thus, the power feed system 16, also referred to interchangeably in the art as a pre-crusher, power feeder, power feed drum, power feed roll or roller, or powerfeed, is an integral component of an efficient horizontal grinder.

A typical power feed wheel 16D usually comprises serrated plates, cleats or other elements, represented in FIG. 2 as teeth 16A, that function to grip the feed material as it is delivered to the fragmenting chamber and rotor therein.

Maintenance of a certain downward pressure of the power feed wheel 16D on the feed material will help regulate the speed with which the material enters the fragmenting chamber and encounters the rotor. This downward pressure assists, inter alia, in preventing the fragmenting rotor 40 from pulling the feed material in too quickly. The downward pressure of the power feed wheel 16D stabilizes the feed material by providing a level of compression and lateral movement of the feed material prior to encountering the rotor, thus improving the efficacy of fragmentation within the fragmenting chamber 14.

Figure 3:
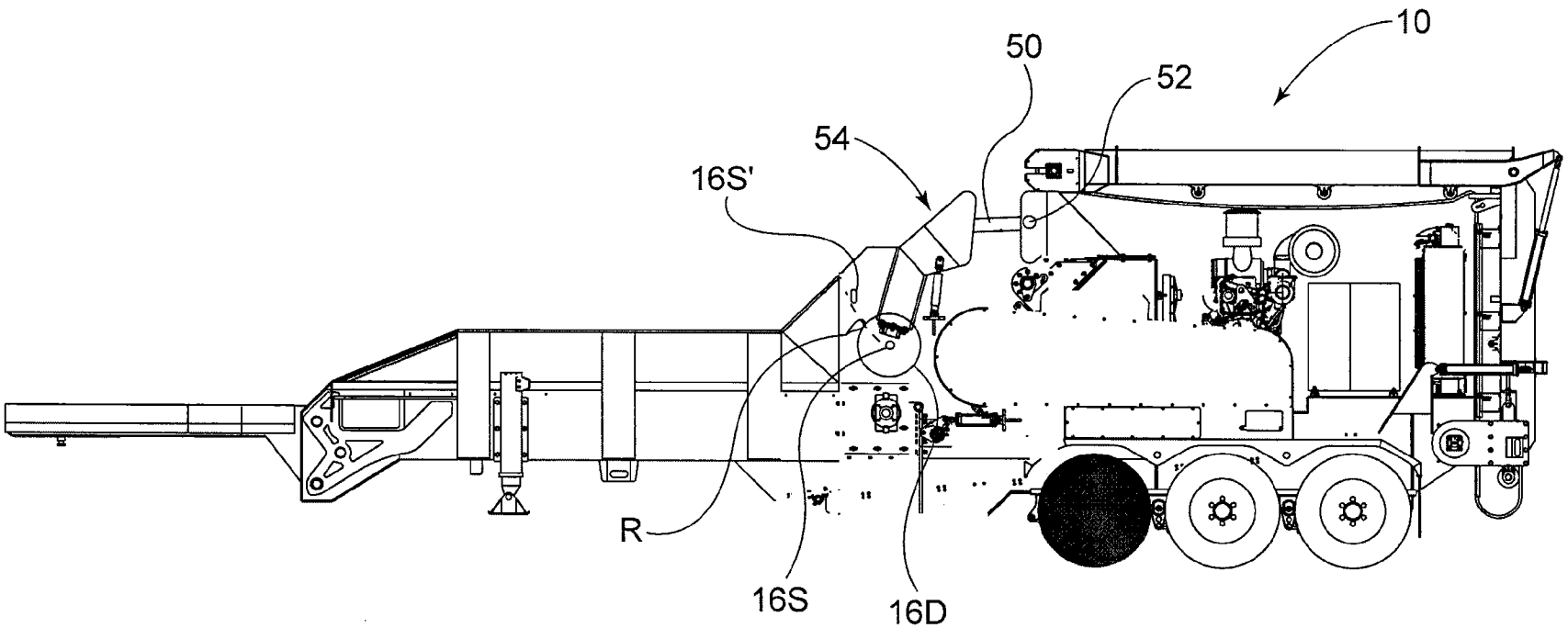
Fig. 3 Prior Art
FIG. 3 is a cross-sectional view of a fragmenting machine.

Known power feed wheels 16D may be fixed in operational position relative to the feed material by arm(s) 16F as illustrated in FIGS. 1 and 2 or, alternatively, as illustrated in FIG. 3 may be pivotally mounted on at least one arm, preferably two arms, 16F that allow the power feed wheel 16D to positionally rotationally adjust to the height of the feed material, rising or lowering in an attempt to maintain a near-continuous pressure on the feed material. Moreover, the known powerfeed wheels 16D may be pivotally mounted on at least one arm 50 with a single rotational pivot point 52 that allows raising or lowering of the power feed wheel 16D in response to the feed material. Typical power feed wheels 16D consist of a single pair of arms 50, pivotally mounted on a single axis, wherein the power feed wheel 16D is rotationally mounted to the arms 50 opposite the rotational axis 52 as illustrated in FIG. 3.

This known arrangement results in the power feed wheel 16D moving in a radial pathway R that is not concentric with the rotor's circumference. R represents the radial pathway taken by the power feed shaft 16S in a lowered position to a raised position, illustrated as 16S'. Known single-pivot rotational power feed wheels 16D comprise a power feed wheel arm 50 radius that is generally greater than the radial pathway circumscribed by the rotating fragmenting rotor teeth within the fragmenting chamber 14.

Moreover, the rotational axis 52 for the single-pivot point arm(s) 50 is generally higher than the rotor axis, which means that the power feed wheel 16F necessarily pivots outwardly away from the rotor as it rises. The result is that the power feed wheel 16F necessarily, and undesirably, moves outwardly and upwardly away from the fragmenting rotor along dashed radial pathway R. Thus, the power feed wheel 16D moves laterally and vertically away from the fragmenting rotor 42. As the lateral and/or vertical distance between the fragmenting rotor 42 and the power feed wheel 16D increase, the power feed wheel 16D loses desired control over the feed material and fragmenting efficacy diminishes. The problem related to increasing vertical distance between the fragmenting rotor 42 and power feed wheel 16D in known machines is directly related to the height of the feed material.

The present invention alleviates, inter alia, these problems.

Figure 4:
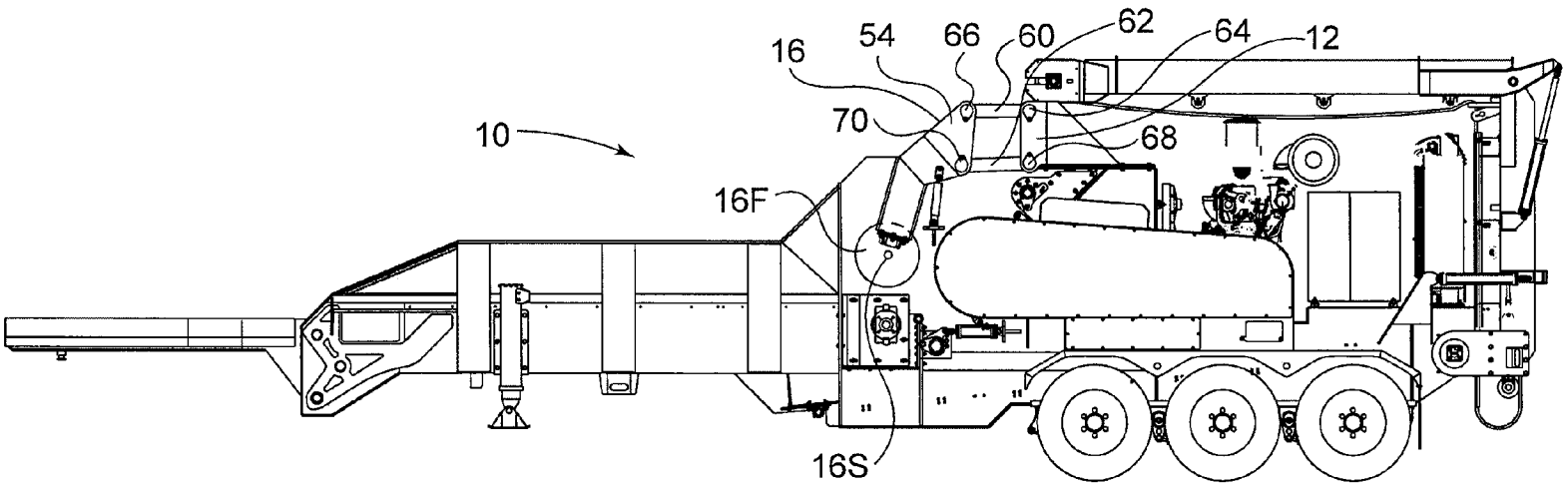
FIG. 4 is a cross sectional view of one embodiment of a fragmenting machine of the present invention.

Turning now to FIG. 4, one embodiment of the present invention is illustrated. Fragmenting machine 10 is illustrated with a power feed system 16 having a power feed wheel 16F with a power feed shaft 16S, wherein the power feed wheel 16F is operatively connected, preferably in fixed connection, with an angular yoke 54 while allowing the powered rotation of power feed wheel 16F about power feed shaft 16S as discussed above. Those skilled in the art will recognize various equivalent configurations for the connection between power feed wheel 16F and yoke 54, as well as various equivalent angles for the yoke 54. Each such equivalent connection and configuration is within the scope of the present invention.

Figure 5:
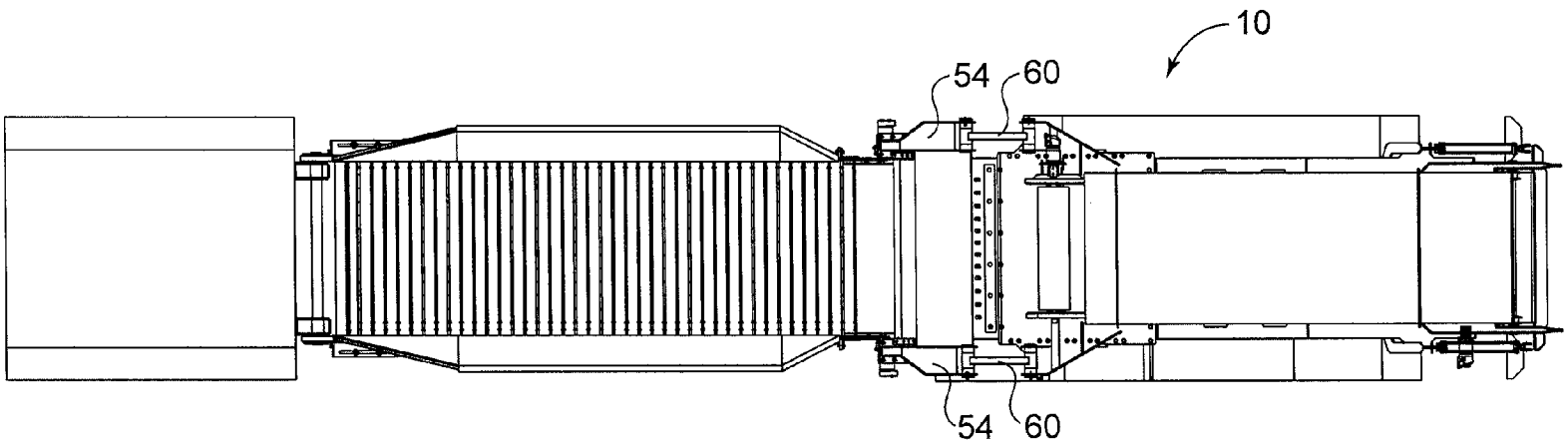
FIG. 5 is a top view of one embodiment of a fragmenting machine of the present invention.

Angled yoke 54 is, in turn, operationally, preferably rotationally, connected to two pairs of linkage arms, an upper linkage arm 60 and a lower linkage arm 62. Upper and lower linkage arms 60, 62 are arranged within the same vertical plane to facilitate raising the power feed wheel 16F. As seen in FIG. 5, linkage arm pairs, e.g., see upper arms 60 in FIG. 5, are located on opposite sides of the power feed system 16 to provide sufficient support for the power feed wheel 16F. The skilled artisan will recognize that in some cases a single pair of linkage arms 60, 62 may be sufficient. Thus, for the present invention, at least one pair of linkage arms, each pair of linkage arms comprising an upper arm 60 and a lower arm 62, is required.

Upper arm 60 is operatively, preferably rotatably, connected to both the fragmenting machine frame 12 at connection 64 and to yoke 54 at connection 66. Lower arm 62 is operatively, preferably rotatably, connected to both the fragmenting machine frame 12 at connection 68 and to yoke 54 at connection 70. The operative connections 64, 66, 68, 70 are well known to those skilled in the art, who will recognize numerous rotatable connection devices, techniques and methods, each of which is within the scope of the present invention.

Each pair of linkage arms comprising upper arm 60 and lower arm 62 is arranged wherein the upper arm 60 is slightly shorter in length than the lower arm 62. Moreover, the upper arm 60 and lower arm 62 within each linkage arm pair are in a non-parallel relationship within the vertical plane. Thus, the vertical distance separating upper arm connector 66 and lower arm connector 70 is greater than the vertical distance separating upper arm connector 64 from lower arm connector 68. Since upper arm 60 is slightly shorter than lower arm 62 and they are arranged in a non-parallel manner as described above, the radial pathway circumscribed by upper arm 60 is slightly shorter than the radial pathway circumscribed by lower arm 62. As will be seen, this results in both the yoke 54 and the power wheel 16F moving laterally toward the fragmenting rotor 40 in any raised position.

Figure 6:
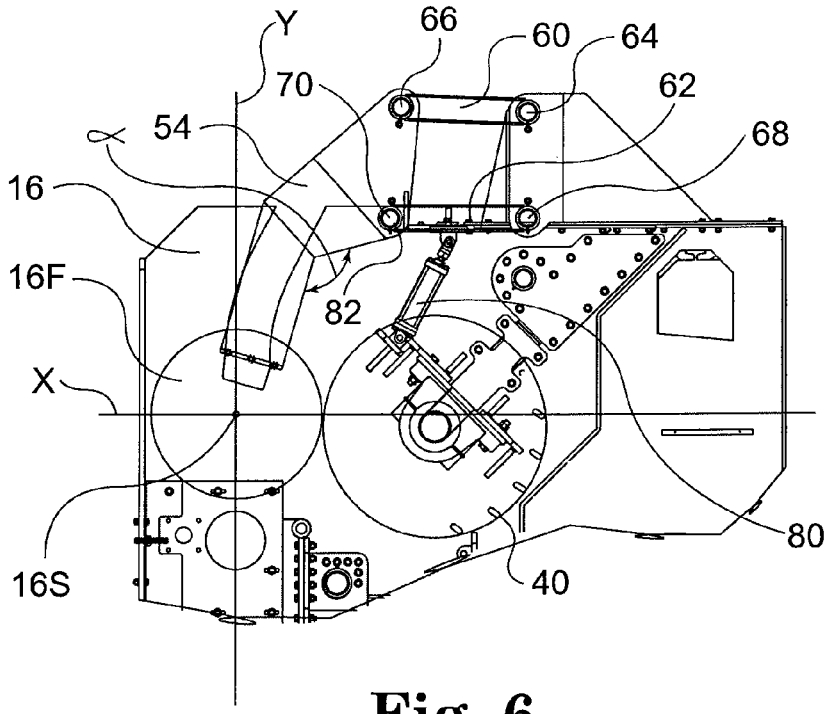
FIG. 6 is a cross-sectional view of one embodiment of the present invention, wherein the power feed wheel is in a lowered position.
Figure 7:
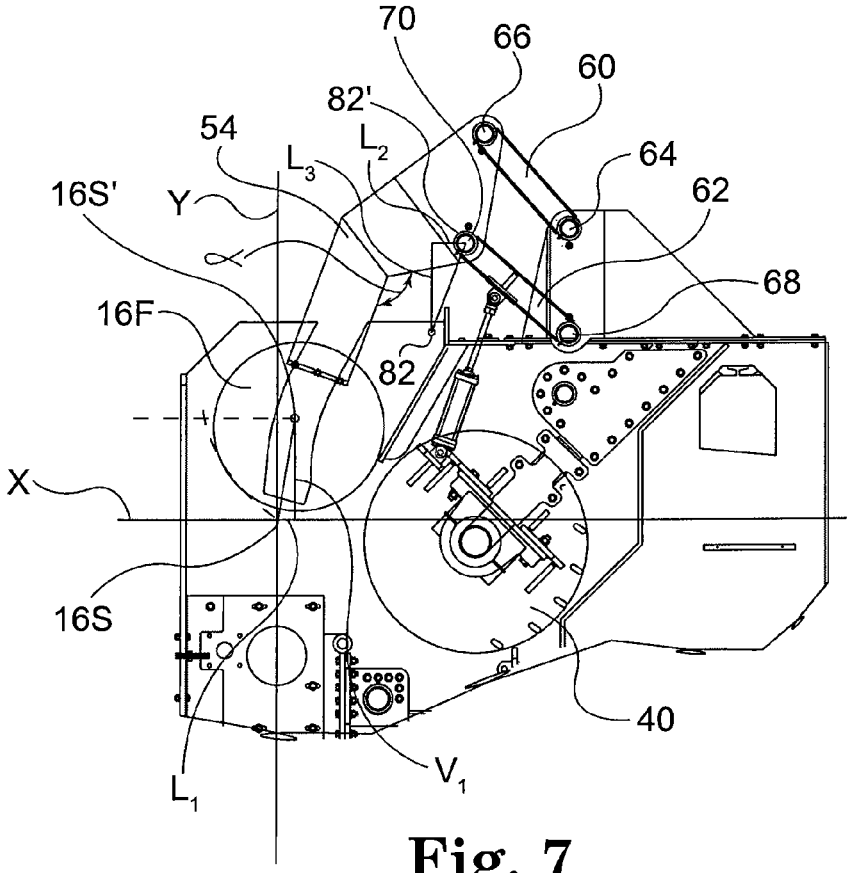
FIG. 7 is a cross-sectional view of one embodiment of the present invention, wherein the power feed wheel is in a raised position.

This relationship is best seen by reference to FIGS. 6 and 7. In FIG. 6, the power feed system 16 is illustrated in the lowered position. Thus, the power feed wheel 16F is in close proximity with fragmenting rotor 40, promoting maximal feeding and fragmenting efficiency. The lowered spatial position of power feed system 16 is marked relative to the position of power feed shaft 16S and located on the X and Y axis superimposed in the Figures. Lowered position as in FIG. 6 is also marked for illustrative purposes with reference to the spatial position 82 of lower arm connector 70. At least one hydraulic cylinder 80, preferably two cylinders 80 are employed, operatively connected with the power feed system 16, more preferably operatively connected with lower arm 62 as illustrated in FIG. 6, assists in maintaining the vertical positioning of the power feed system 16.

FIG. 7 illustrates the power feed system 16 in a raised position. As can be seen, linkage arms 60, 62 adjust vertically and laterally the position of the yoke 54, and thus the power feed wheel 16F and power feed shaft 16S to accommodate the size of the feed material being delivered to the fragmenting rotor 40. The spatial position of the power feed wheel 16F relative to the fragmenting rotor 40, in any position, raised or lowered or any point therebetween, is dictated by the unequal length and non-parallel relationship between upper arm(s) 60 and lower arm(s) 62. As will be appreciated, if the linkage arms were the same length and in a parallel relationship with each other, the power feed wheel 16F would, in a raised position, be moved undesirably laterally away from the fragmenting rotor 40.

As illustrated in FIG. 7, the inventive power feed system results in the power feed wheel 16F actually moving laterally toward the fragmenting rotor 40 in a raised position. As seen with reference to the X and Y axis, power feed shaft 16S has moved vertically a distance of $V_1$ and a lateral distance of $L_1$, as measured with reference to the lowered position of power feed shaft 16S and the raised position of power feed shaft 16S'. Lateral movement distance $L_1$ is toward, or in the direction of the fragmenting rotor 40, thus maintaining proximity between power feed wheel 16S and rotor 40, promoting fragmenting efficiency. Moreover, as will be readily appreciated by the skilled artisan, the lateral distance traveled, e.g., $L_1$, is much smaller than the vertical distance traveled, e.g., $V_1$.

This movement is made possible by the movement of upper arm 60 and lower arm 62, raised by the presence of feed material under the power feed wheel 16S and with the assistance of hydraulic cylinder 80, not shown in FIG. 7. Upper arm connector 64 and lower arm connector 68 do not move spatially, either laterally or vertically. Instead, connectors 64 and 68 simply allow upper arm 60 and lower arm 62 to rotate therein. However upper arm connector 65 and lower arm connector 70 do raise or lower in response to feed material requirements and, as a result, do undergo spatial translational motion, both vertically and laterally. The vertical motion is illustrated with respect to connector 70 by $V_2$ and laterally by $L_2$. As with the power feed wheel shaft 16S, the lower arm connector 70 moves laterally a distance of $L_2$ toward the fragmenting rotor 40 as it is raised vertically a distance of $V_2$ from the lowered position seen in FIG. 6. As with the power feed wheel shaft 16S, advantageously, the vertical distance, e.g., $V_2$ is much larger than the lateral distance traveled, e.g., $L_2$. The upper arm 60 and upper arm connector 66 undergo a similar lateral and vertical movement. This relationship enables the yoke 54 to maintain a substantially similar angular orientation while moving vertically throughout the positioning of the power feed system 16. The yoke 54 is angular, with substantially constant angle $\alpha$ to assist in maintaining proximity of the power feed wheel 16S to the fragmenting rotor 40 as those skilled in the art will readily ascertain. Alternatively, angle $\alpha$ may change slightly to assist in achieving one or more objects of the present invention. In the embodiment wherein angle $\alpha$ is fixed or constant, the skilled artisan will recognize that changing the parameters of the system, e.g., the diameter of the power feed wheel 16S, the lengths of the upper arm 60 and lower arm 62 and the location of the connectors 64, 66, 68 and 70 relative to each other, may necessitate another choice for yoke 54 angle $\alpha$ to achieve the efficiencies provided by the present invention.

A method according to the present invention comprises:

providing a waste fragmenting machine having a power feed system mounted thereon;

raising the power feed system from a lowered position; and maintaining proximity of the power feed wheel to the fragmenting rotor.

Additional embodiments may comprise moving the power feed wheel laterally in the direction of the fragmenting rotor while raising the power feed system from a lowered position.

Further embodiments may comprise providing at least one pair of linkage arms, wherein the upper arm has a length shorter than the upper arm and wherein the upper and lower arms are arranged within the same vertical plane but are not parallel to one another.

As discussed above, the present invention provides for maintaining and promoting proximity between the power feed wheel 16F and the fragmenting rotor 40 of fragmenting machines. This has several benefits including, inter alia, improving feed material stability, improved feed rate control, which, in turn, improves horsepower efficiency and lessens machine downtime due to plugging of fragmenting chamber inlet. The latter benefit results from the power feed wheel 16F being in proximity with the fragmenting rotor 40 under the present invention and thus more effectively limiting the speed with which objects can be pulled into the fragmenting chamber 14. Thus, the power feed exerts a stabilizing downward pressure on the feed material which provides feed stability and controlled feed rates. The present invention provides greater control over the speed with which an object enters the radial pathways of the fragmenting rotor teeth, thereby providing a level of control over the depth of cut each fragmenting tooth takes into the object. The increased controls provided by the present invention are made possible by ensuring that this downward pressure is always applied close or proximate to the rotor where the feed material may be most effectively stabilized and compressed.

The present invention further provides improved control over partially fragmented materials. Feed materials do not simply fragment into smaller pieces when struck by the rotor teeth and quickly pass over and through the sizing apparatus or screen. The space between the power feed wheel 16F and the fragmenting rotor 40 is filled by the turbulent motion of particles of various sizes. Often, particles will circulate around the screen until they reach the front of the rotor 40 where they may be propelled away from the rotor and toward the power feed wheel 16F. Particles may also be cast from rotor 40 upon initial impact therewith. By enabling proximity between the power feed wheel 16F and the fragmenting rotor 40, the present invention may allow more effective delivery, or redelivery, of these particles to the fragmenting rotor 40. Moreover, the power feed wheel 16F may act as an anvil in such cases, i.e., for oversized particles in particular passing around to the front of the rotor 40 where they may be sheared between the power feed wheel 16F and the fragmenting rotor teeth.

As discussed above, the present invention will allow equipment designers to establish ideal lift paths for the power feed system 16, e.g., power feed wheel 16F, for individual machines based on typical processed materials, horsepower and size of and relationships between the machine components.

The present invention should not be considered limited to the particular examples described above, but rather should be understood to cover all aspects of the invention. Various modifications, equivalent processes, as well as numerous structures to which the present invention may be applicable will be readily apparent to those of skill in the art to which the present invention is directed upon review of the present specification.

What is claimed is:

1. A fragmenting machine having a frame and comprising a feeding means for feeding waste materials to the machine;

an at least partially enclosed fragmenting chamber, the fragmenting chamber housing a fragmenting rotor therein;

a power feed system in operative connection with the feeding means and the fragmenting chamber;

the power feed system comprising a power feed wheel on a power feed shaft, an angular yoke operatively connected to the power feed wheel and at least one pair of linkage arms in operative connection with the fragmenting machine frame and with the angular yoke, the at least one pair of linkage arms comprising an upper arm and a lower arm, wherein the upper and lower arms are arranged within the same vertical plane.

2. The fragmenting machine of claim 1, further comprising the upper arm and lower arm each having a length, wherein the length of the upper arm is shorter than the length of the lower arm.

3. The fragmenting machine of claim 1, further comprising the upper arm and the lower arm being arranged so that they are not parallel with each other.

4. The fragmenting machine of claim 3, further comprising the operative connections of the upper and lower arms with the angular yoke having a distance therebetween that is greater than a distance between the operative connections of the upper and lower arms with the machine frame.

5. The fragmenting machine of claim 1, further comprising at least one hydraulic cylinder in operative connection with the power feed system.

6. The fragmenting machine of claim 4, further comprising the hydraulic cylinder in operative connection with the lower arm.

7. The fragmenting machine of claim 1, further comprising the power feed system being movable from a lowered position to a raised position in response to the waste material.

8. The fragmenting machine of claim 6, further comprising the power feed wheel capable of being moved laterally toward the fragmenting rotor as the power feed system is moved from a lowered to a raised position.

9. The fragmenting machine of claim 7, wherein the operative connection of upper and lower arms to the angular yoke allows rotation of the upper and lower arms within the operative connection and allows vertical and lateral movement of the yoke and of the power feed wheel relative to the fragmenting rotor, wherein the power feed wheel is moved laterally toward the fragmenting rotor when power feed system is in a raised position.

10. A fragmenting machine having a frame and comprising:

a feeding means for feeding waste materials to the machine;

an at least partially enclosed fragmenting chamber, the fragmenting chamber housing a fragmenting rotor therein;

a power feed system in operative connection with the feeding means and the fragmenting chamber;

the power feed system comprising a power feed wheel on a power feed shaft, an angular yoke operatively connected to the power feed wheel and at least one pair of linkage arms in operative connection with the fragmenting machine frame and with the angular yoke, the at least one pair of linkage arms comprising an upper arm and a lower arm, the upper and lower arms being arranged within the same vertical plane, the upper arm and lower arm each having a length, wherein the length of the upper arm is shorter than the length of the lower arm, and wherein the upper and lower arms are not parallel with each other.

11. The fragmenting machine of claim 10, further comprising the operative connections of the upper and lower arms with the angular yoke having a distance therebetween that is greater than a distance between the operative connections of the upper and lower arms with the machine frame.

* * * * *